US007441610B2

(12) United States Patent
Belnap et al.

(10) Patent No.: US 7,441,610 B2
(45) Date of Patent: Oct. 28, 2008

(54) ULTRAHARD COMPOSITE CONSTRUCTIONS

(75) Inventors: J. Daniel Belnap, Pleasant Grove, UT (US); Anthony Griffo, The Woodlands, TX (US); Ronald K. Eyre, Orem, UT (US); Stewart N. Middlemiss, Salt Lake City, UT (US)

(73) Assignee: Smith International, Inc., Houston, TX (US)

( * ) Notice: Subject to any disclaimer, the term of this patent is extended or adjusted under 35 U.S.C. 154(b) by 287 days.

(21) Appl. No.: 11/067,582

(22) Filed: Feb. 25, 2005

(65) Prior Publication Data

US 2006/0191722 A1 Aug. 31, 2006

(51) Int. Cl.
*E22F 3/00* (2006.01)
*C22C 1/99* (2006.01)

(52) U.S. Cl. ..... 175/374; 428/469; 428/698

(58) Field of Classification Search ..... 175/374; 428/408, 469, 698, 704
See application file for complete search history.

(56) References Cited

U.S. PATENT DOCUMENTS

| | | | |
|---|---|---|---|
| 4,017,480 | A | 4/1977 | Baum |
| 4,142,888 | A | 3/1979 | Rozmus |
| 4,255,165 | A | 3/1981 | Dennis et al. |
| 4,341,557 | A | 7/1982 | Lizenby |
| 4,368,788 | A | 1/1983 | Drake |
| 4,372,404 | A | 2/1983 | Drake |
| 4,378,975 | A | 4/1983 | Tomlinson et al. |
| 4,398,952 | A | 8/1983 | Drake |
| 4,428,906 | A | 1/1984 | Rozmas |
| 4,525,178 | A | 6/1985 | Hall |
| 4,593,776 | A | 6/1986 | Salesky et al. |

(Continued)

FOREIGN PATENT DOCUMENTS

| | | | |
|---|---|---|---|
| EP | 0 012 631 | A1 | 6/1980 |

(Continued)

OTHER PUBLICATIONS

Flaw Tolerant, Fracture Resistant, Non-Brittle Materials Produced Via Conventional Powder Processing, Technological Advances, Jul./Aug. 1995, Matrice Technology Ltd., vol. 10, No. 7/8, pp. 131-134.

(Continued)

*Primary Examiner*—William P Neuder
(74) *Attorney, Agent, or Firm*—Connolly Bove Lodge & Hutz LLP

(57) ABSTRACT

Ultrahard composite constructions comprise a plurality of first phases dispersed within a matrix second phase, wherein each can comprise an ultrahard material including PCD, PcBN, and mixtures thereof. The constructions are formed from a plurality of granules that are combined and sintered at HP/HT conditions. The granules include a core surrounded by a shell and both are formed from an ultrahard material or precursor comprising an ultrahard constituent for forming the ultrahard material. When sintered, the cores form the plurality of first phases, and the shells form at least a portion of the second phase. The ultrahard material used to form the granule core may have an amount of ultrahard constituent different from that used to form the granule shell to provide desired different properties. The ultrahard constituent in the granule core and shell can have approximately the same particle size.

44 Claims, 7 Drawing Sheets

U.S. PATENT DOCUMENTS

| | | | |
|---|---|---|---|
| 4,604,106 | A | 8/1986 | Hall et al. |
| 4,656,002 | A | 4/1987 | Lizenby et al. |
| 4,673,549 | A | 6/1987 | Ecer |
| 4,694,918 | A | 9/1987 | Hall |
| 4,723,996 | A | 2/1988 | Brunet et al. |
| 4,772,524 | A | 9/1988 | Coblenz |
| 4,797,241 | A | 1/1989 | Peterson |
| 4,866,885 | A | 9/1989 | Dodsworth |
| 4,945,073 | A | 7/1990 | Dubensky et al. |
| 5,089,182 | A | 2/1992 | Findelisen et al. |
| 5,096,465 | A | 3/1992 | Chen et al. |
| 5,151,107 | A | 9/1992 | Cho et al. |
| 5,271,749 | A | 12/1993 | Rai et al. |
| 5,288,297 | A | 2/1994 | Ringwood |
| 5,290,507 | A | 3/1994 | Runkle |
| 5,304,342 | A | 4/1994 | Hall, Jr. et al. |
| 5,326,380 | A | 7/1994 | Yao et al. |
| 5,370,195 | A | 12/1994 | Keshavan et al. |
| 5,419,868 | A | 5/1995 | Honnorat |
| 5,441,817 | A | 8/1995 | Rai |
| 5,453,105 | A | 9/1995 | Middlemiss et al. |
| 5,492,186 | A | 2/1996 | Overstreet et al. |
| 5,598,621 | A | 2/1997 | Littecke et al. |
| 5,645,781 | A | 7/1997 | Popovic et al. |
| 5,662,183 | A | 9/1997 | Fang |
| 5,676,496 | A | 10/1997 | Littecke et al. |
| 5,712,030 | A | 1/1998 | Goto et al. |
| 5,755,299 | A | 5/1998 | Langford |
| 5,813,105 | A | 9/1998 | Littecke et al. |
| 5,830,813 | A | 11/1998 | Yao et al. |
| 5,880,382 | A | 3/1999 | Fang et al. |
| 5,944,127 | A | 8/1999 | Liang et al. |
| 6,063,502 | A | 5/2000 | Sue et al. |
| 6,102,140 | A | 8/2000 | Boyce et al. |
| 6,187,068 | B1 | 2/2001 | Frushour et al. |
| 6,258,139 | B1 | 7/2001 | Jensen |
| 6,290,008 | B1 | 9/2001 | Portwood et al. |
| 6,325,165 | B1 | 12/2001 | Eyre |
| 6,361,873 | B1 * | 3/2002 | Yong et al. ..... 428/469 |
| 6,454,027 | B1 | 9/2002 | Fang et al. |
| 6,592,985 | B2 | 7/2003 | Griffin et al. |
| 6,607,835 | B2 | 8/2003 | Fang et al. |
| 6,696,137 | B2 | 2/2004 | Yong |
| 6,805,946 | B2 * | 10/2004 | Mulligan et al. ..... 428/292.4 |
| 7,243,744 | B2 * | 7/2007 | Griffo ..... 175/426 |
| 2005/0051366 | A1 | 3/2005 | Frushour |
| 2005/0133277 | A1 * | 6/2005 | Dixon ..... 175/426 |
| 2005/0275143 | A1 * | 12/2005 | Toth ..... 264/646 |
| 2006/0222853 | A1 * | 10/2006 | Sue et al. ..... 428/408 |
| 2007/0178163 | A1 * | 8/2007 | Kodas et al. ..... 424/489 |

FOREIGN PATENT DOCUMENTS

| | | |
|---|---|---|
| EP | 0 052 922 | 6/1982 |
| EP | 0 365 843 A1 | 5/1990 |
| EP | 0 774 527 | 5/1997 |
| EP | 0 278 793 | 8/1998 |
| GB | 1572460 | 7/1980 |
| GB | 1574615 | 9/1980 |
| GB | 2239028 | 6/1991 |
| GB | 2286599 | 8/1995 |
| GB | 2315775 | 11/1998 |
| GB | 2315778 | 11/1998 |
| JP | 62274034 | 11/1987 |
| JP | 849037 | 2/1996 |
| WO | 8103295 | 11/1981 |
| WO | 9636465 | 11/1996 |
| WO | 00/38864 | 7/2000 |
| WO | 2004/040029 A1 | 5/2004 |
| WO | 2004/111284 A4 | 12/2004 |

OTHER PUBLICATIONS

Research & Development Summaries, Advance Ceramics Research, Aug. 18, 1996, 4 Summaries, 2 to 3 pages each.

* cited by examiner

ULTRAHARD COMPOSITE CONSTRUCTIONS

FIELD OF THE INVENTION

This invention relates to ultrahard composite constructions comprising multiple ultrahard material phases and, more particularly, to ultrahard composite constructions formed by combining and sintering granules having a core and shell each made from ultrahard materials or precursor components selected to impart improved combined physical properties to resulting composite constructions formed therefrom when compared to conventional monolithic ultrahard or ultrahard composite compositions.

BACKGROUND OF THE INVENTION

Ultrahard materials such as polycrystalline diamond (PCD) and polycrystalline cubic boron nitride (PcBN) are known in the art. Conventional PCD is formed from combining diamond grains or crystals with a binder/catalyst material and processing the same at high pressure/high temperature (HP/HT) conditions. Such ultrahard materials have well known properties of wear resistance that make them a popular material choice for use in certain industrial applications, such as cutting tools for machining and subterranean mining and drilling bits where wear resistance is highly desired. For example, conventional PCD can be used to form wear or cutting surfaces of cutting elements used with fixed body and rotary cone subterranean drilling bits to impart an improved degree of improved wear resistance thereto.

Conventional PCD has a material microstructure characterized by a plurality of bonded together diamond grains, forming an intercrystalline bonded diamond phase, and a plurality of interstitial regions interposed between the diamond grains that contain the binder/catalyst material used to catalyze the bonding of the diamond grains. While this material microstructure provides known properties of improved wear resistance when compared to other non-PCD materials, it is also known to be relatively brittle, thus limiting practical use of such convention PCD to those applications calling for an improved degree of wear resistance but not requiring a high degree of toughness.

However, because many industrial wear and cutting applications require an improved degree of both wear resistance and toughness, attempts were made in the art to address this need by either varying the content of the diamond grain and binder/catalyst material used to form the PCD, and/or by varying the size or grade of the diamond grains used to form the PCD. While these approaches did achieve some improvement in the toughness of the PCD, they did so at the expense or sacrifice or wear resistance.

Further attempts were made to produce a PCD material having the desired improvements in toughness, but without sacrificing wear resistance. One such attempt focused on developing a two-phase composite construction having a material microstructure comprising an arrangement of PCD material phases dispersed within a ductile binder material matrix phase. In this construction, the PCD material phases operated to impart a desired level of wear resistance while the ductile binder matrix phase operated to impart a desired degree of toughness to the resulting composite construction. While this approach was successful in reducing the amount of wear resistance sacrificed while improving the degree of toughness for a PCD-containing material when compared to the prior attempts made with monolithic PCD materials, a desired degree or level of both properties was still not achieved as needed to meet certain demanding end use applications.

Such prior art attempts of developing PCD materials suitable for use in wear and/or cutting applications calling for heightened degrees of both wear resistance and toughness have all approached such need from the perspective of increasing the toughness of inherently brittle PCD materials.

Additionally, in each of the above-described prior art approaches, the PCD material or PCD phase of the composite construction, was formed in the manner noted above. Namely, by starting with combining diamond grains with a binder/catalyst material as the starting feedstock and then subjecting the same to HP/HT processing. In the above-noted PCD composite construction, the PCD material phase was formed by combining diamond grains with the binder/catalyst material and a suitable processing agent for forming a green-state particle, and then dispersing the particles into a further ductile binder material. Accordingly, in each instance the PCD material or composite construction phase was formed by starting with diamond grains as the feedstock material.

Currently, a need exists to facilitate and expedite the process of forming ultrahard material constructions. Further, it has been discovered that for certain ultrahard materials already known to have a desired degree of toughness, a need exists for improving the wear resistance of these materials to make them better suited for applications calling for heightened levels of both toughness and wear resistance.

It is, therefore, desired that ultrahard material constructions be developed that have desired properties of both toughness and wear resistance, making them suitable for use in demanding industrial wear and/or cutting applications that require heightened levels of both wear resistance and toughness not otherwise obtainable from conventional monolithic PCD materials or known PCD composite constructions. It is also desired that a constituent useful for forming such ultrahard material constructions, and a method for making the constituent and the ultrahard material constructions, be developed for the purpose of facilitating the process of preparing such ultrahard material constructions.

SUMMARY OF THE INVENTION

Ultrahard composite constructions of this invention are characterized by having a material microstructure comprising a plurality of first material phases or regions that are dispersed within a matrix second material phase or region. The first and second material phases can each comprise an ultrahard material selected from the group including polycrystalline diamond, polycrystalline cubic boron nitride, and mixtures thereof.

The composite construction is formed by combining a plurality of granules, and sintering and consolidating the combined granules under high pressure/high temperature conditions. The granules each comprise a central core that is formed from an ultrahard material or precursor comprising an ultrahard constituent for forming the ultrahard material, and upon sintering and consolidation the granule core forms the composite construction plurality of first material phases.

The granules further comprise a shell or coating that surrounds the core and that can also be formed from an ultrahard material or precursor comprising an ultrahard constituent for forming the ultrahard material. The shell or coating can be formed from a material that prevents or minimizes the infiltration of materials into the core during the sintering and consolidation process. Upon sintering and consolidation, the combined granule shells forms at least a portion of the composite construction second material phase. Additionally, the coated granules can be combined with a further material that forms at least a portion of the composite constriction second material phase during sintering and consolidation.

If desired, the granule may comprise more than one coating or shell, and the ultrahard material used to form the plurality of first material phases may have a volume fraction of ultrahard constituent that is different from that in the ultrahard material used to form the second material phase to provide a desired difference in one or more properties of the core and shell. In an example embodiment, the ultrahard constituent used to form the granule core and shell can have approximately the same particle size.

The shell or coating can be applied to the granule core by treating the granule core to provide a tacky surface, and then coating the tacky surface with the ultrahard material used to form at a least portion of the composite construction second material phase. In an example embodiment, the step of treating comprises applying an activating agent to the granule core that interacts with a binding agent in the core to form the tacky surface.

Ultrahard composite constructions of this invention can be provided in the form of a compact prepared by combining a suitable substrate with the combined granules prior to sintering and consolidation, wherein during sintering and consolidation the substrate is joined to the resulting ultrahard composite construction.

Ultrahard composite constructions of this invention comprising the material microstructure noted above display improved combined properties of toughness and wear resistance when compared to conventional monolithic ultrahard materials, making them well suited for use in demanding industrial wear and/or cutting applications such as for use a cutting elements in subterranean drill bits. Further, the formation of the above-described granules operates to facilitate the process of making such ultrahard composite constructions, because the granules can be stored as feedstock for future use, thereby avoiding the need to always start by using precursor components or materials.

BRIEF DESCRIPTION OF THE INVENTION

These and other features and advantages of the present invention will become appreciated as the same becomes better understood with reference to the specification, claims and drawings wherein:

DETAILED DESCRIPTION OF THE INVENTION

Ultrahard composite constructions of this invention generally comprise a plurality of first regions or material phases that are disposed within a continuous matrix second region or material phase, wherein both the first and second regions are formed from the same or different ultrahard materials or precursor components useful for making the same. In an example embodiment, the first and second regions comprise the same general type of ultrahard materials that have been engineered, treated or processed to provide a different physical or mechanical property. Further, ultrahard composite constructions of this invention are formed from granules or particles each comprising a core and surrounding shell, wherein the core and shell are each formed from the ultrahard materials or precursor components useful for making the same.

As used in this specification, the term polycrystalline diamond, along with its abbreviation "PCD," is understood to refer to diamond-containing materials that are produced by subjecting individual diamond crystals or grains and additives to sufficiently high pressure and high temperature conditions such that intercrystalline bonding occurs between adjacent diamond crystals. A characteristic of PCD is that the diamond crystals be bonded to each other to form a rigid body.

Figure 1:
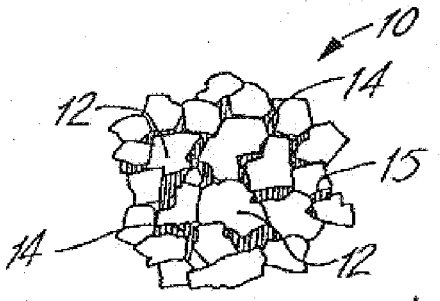
FIG. 1 is a schematic microstructure taken in cross-section of a conventional monolithic ultrahard material.

FIG. 1 illustrates the material microstructure of a conventional PCD material 10 comprising a plurality of diamond grains 12 that are bonded to one another by a binder/catalyst material 14, e.g., a solvent metal catalyst material such as cobalt. Desired properties of such conventional PCD materials are, for example, wear resistance, high modulus, and high compressive strength. Such conventional PCD materials may comprise a binder/catalyst material content up to about 30 percent by weight, and the binder/catalyst material can be selected from the group including Co, Ni, Fe, and mixtures thereof. The particular amount of binder/catalyst material that is used is typically controlled to provide compromise properties of toughness and wear resistance.

Figure 2A:
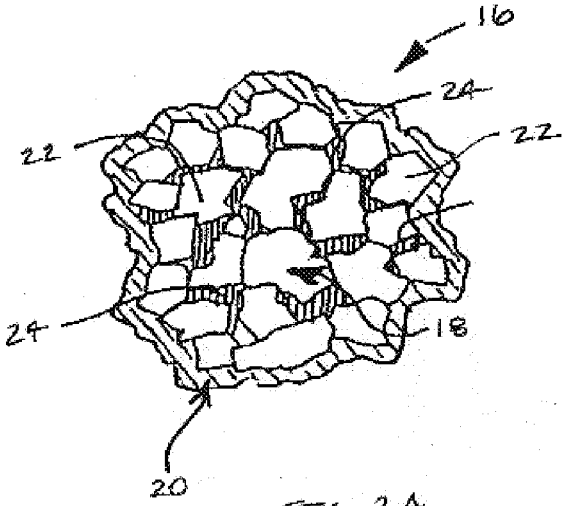
FIG. 2A is a schematic microstructure taken in cross-section of an ultrahard material granule prepared according to principles of this invention.

FIG. 2A illustrates a granule or particle 16 prepared according to the principles of this invention, formed from ultrahard materials or precursor components for forming the same. The granule 16 generally comprises a core 18 and a shell or coating 20 disposed around the core. In an example embodiment, the shell or coating 20 encapsulates the core 18 such that the core is substantially surrounded in three dimensions by the shell or coating. The core is formed from an ultrahard material or precursor components used to form the same, and the shell or coating is also formed from an ultrahard material or precursor components used to form the same. Suitable ultrahard materials useful for forming granules of this invention include PCD, PcBN and mixtures thereof, and suitable precursor components for forming such ultrahard materials include diamond grains, cBN grains, and mixtures thereof.

In an example embodiment, the granules are provided in green-state or presintered form and comprise diamond grains as the precursor component for forming a sintered PCD ultrahard material, wherein the core 18 comprises a mixture of diamond grains 22 and a binder/catalyst material 24. The diamond grains can be synthetic or natural, and can have a grain size of from submicrometer to 100 micrometers. Natural diamond grains may be useful in certain applications calling for a rigidly controlled or lean amount of catalyst material. In an example embodiment, the diamond grains used to form the granule core can have an average grains size in the range of from about 0.1 to 80 micrometers, and preferably from about 2 to 50 micrometers. In an example embodiment, the diamond grains used to form the core have an average grain size of about 5 micrometers.

Binder/catalyst materials 24 useful for forming granules of this invention include those used to form conventional PCD materials, such as metal solvent catalysts or other materials useful for facilitating the bonding together of the diamond grains. Suitable binder/catalyst materials include those selected from Group VIII elements of the Periodic table, such as Co, Ni, Fe, and mixtures thereof.

In addition to the diamond grains and binder/catalyst material, the granule may contain additional materials such as metals or cements which are added to function as sintering aids, grain growth inhibitors or simply as by-products of powder processing. For example, WC—Co and Fe are often found in PCD microstructures as a by-product of milling/blending diamond powders using WC—Co media and steel containers.

Additionally, the granules may also comprise a binding agent to facilitate handling and forming the diamond and binder/catalyst mixture into the desired granule size and shape. Binding agents useful in forming diamond granules of this invention can include thermoplastic materials, thermoset materials, aqueous and gelation polymers, as well as inorganic binders. Suitable thermoplastic polymers include polyolefins such as polyethylene, polyethylene-butyl acetate (PEBA), ethylene vinyl acetate (EVA), ethylene ethyl acetate (EEA), polyethylene glycol (PEG), polysaccharides, polypropylene (PP), poly vinyl alcohol (PVA), polystyrene (PS), polymethyl methacrylate, polyethylene carbonate (PEC), polyalkylene carbonate (PAC), polycarbonate, polypropylene carbonate (PPC), nylons, polyvinyl chlorides, polybutenes, polyesters, waxes, fatty acids (stearic acid), natural and synthetic oils (heavy mineral oil), and mixtures thereof.

The binding agent can also be selected from the group of thermoset plastics including polystyrenes, nylons, phenolics, polyolefins, polyesters, polyurethanes. Suitable aqueous and gelation systems include those formed from cellulose, alginates, polyvinyl alcohol, polyethylene glycol, polysaccharides, water, and mixtures thereof. Silicone is an example inorganic polymer binder also useful for forming granules of this invention.

An exemplary diamond granule binding agent comprises a plasticizer/solvent system that includes a mixture of polypropylene carbonate (PPC) binding agent, and butyl benzyl phthalate and methyl ethyl ketone (MEK) plasticizer/solvent system, which can be tailored to provide desired fragmentation behavior when forming the granules into a particular size. The particular plasticizer/solvent system also is useful for producing granules that have a desired low solubility in solvents such as heptane for reasons described below.

In an example embodiment, where the granule core comprises a PCD precursor component, the granule core may comprise 75 percent by volume or more diamond grains, 10 percent by volume or less binder/catalyst material, and 20 percent by volume or less binding agent. In an example embodiment, the granule core prior to sintering comprises in the range of from about 75 to 85 percent by volume diamond grains, 0 to 10 percent by volume binder/catalyst material, and about 10 to 20 percent by volume binding agent. In a preferred embodiment, the granule core comprises about 0 to 2 percent by volume binder/catalyst material prior to sintering.

Granules cores of this invention comprising diamond grains may or may not include binder/catalyst material depending on such factors as the type of diamond grains used, e.g., natural or synthetic, and on the material used to form the shell. For example, if the granule shell is formed using a mixture of diamond grains and binder/catalyst material, the binder/catalyst material in the shell material can infiltrate into the core to assist with PCD formation in the core during consolidation and sintering. In the event that the diamond grains used to form the core do not inherently include any or a desired amount of binder/catalyst material, and the shell material or other material surrounding the diamond granule does not include any or a desired amount of binder/catalyst material, to form PCD in the core during consolidation and sintering, the granule core prior to sintering may comprise in the range of from 0.5 to 10 percent by volume binder/catalyst material.

It is to be understood that the above-described characteristics of the material used to form the granule core can and will vary depending on the particular combination of properties that are desired in the sintered ultrahard composite construction. For the example embodiment noted above, such properties give rise to a sintered PCD material having a relatively high degree of wear resistance, which property will be contributed to the resulting sintered ultrahard composite construction.

In the above-noted example embodiment, the granule core is formed by combining the diamond grains, binder/catalyst material, and binding agent in the desired proportions to form a conformable mixture. While the process of preparing granules is described with respect to an example where the resulting sintered material will be PCD, it is to be understood that this is but one example and that granules used for forming ultrahard composite constructions of this invention can also be formed from other types of precursor materials useful for forming ultrahard materials when sintered, such as cBN to produce PcBN. Accordingly, granule cores of this invention can be formed from PCD or PcBN precursor materials by the processes described in U.S. Pat. Nos. 4,604,106; 4,694,918; 5,441,817; and 5,271,749, that are each incorporated herein by reference.

If desired, rather than using a precursor material, granules useful for forming ultrahard composite constructions of this invention can comprise a sintered ultrahard material that is subsequently coated with a shell material. An example of such embodiment would be one where the granule core comprises a homogeneous microstructure of PCD and/or PcBN. An alternative example of such embodiment is one where the granule core comprises an arrangement of PCD and/or PcBN particles that are combined together with the binding agents, and/or binder/catalyst materials, and/or the additional materials described above. The sintered ultrahard material used to form the granule core in such example embodiment can either include or be substantially free of a binder/catalyst material by leaching or other suitable treatment that minimizes or eliminates any negative impact that the any such binder/catalyst material may have on the resulting sintered granule core at elevated temperatures.

The conformable mixture used to form the granule core is then treated, e.g., fragmented, for the purpose of forming the desired individual granules or particles. In an example embodiment, the conformable mixture is formed into granules by the processes of masticating, crushing/reducing and sieving. It is to be understood that this is but one method of forming granule cores of this invention and that other methods useful for converting the conformable mixture to a desired granule core size and configuration can be used and are within the scope of this invention.

In an example embodiment, the conformable mixture was formed into granule cores by masticating a diamond/cobalt mixture with the polypropylene carbonate (PPC)/butyl benzyl phthalate/methyl ethyl ketone (MEK), evaporating the MEK solvent, and cooling the mixture using a cooling bath suitable to reduce the temperature of the mixture to permit mechanical fragmentation of the mixture. The cooled mixture was subjected to mechanical milling using conventional mechanical milling equipment, e.g., such as that used in the food processing industry. After milling, the resulting granule cores were segregated by mechanically sieves into particles that were larger than the desired size, particles that were correctly sized, and particles that were undersized. Granule cores having a particle size larger than the desired size were re-subjected to the cooling/crushing process. Granule cores having a particle size smaller than the desired size were re-masticated before being subjected to the cooling/crushing process. By this process, further milling or reconsolidation and milling can be performed as needed until a desired granule core size is obtained.

Granule cores can also be prepared by taking an ultrahard material or precursor component provided in the form of tape, extruded rods/fibers, or other geometries, and granulating these in the same manner noted above, e.g., by cooling, milling, sieving, etc. For example PCD precursor components provided in the form of diamond tape can be sized and shaped to form granule cores.

The granule cores can have equi-axe shapes, e.g., can be in the form of polygons or spheres, or can be in the form of short fibers. It is to be understood that the granule cores useful for forming ultrahard composite constructions of this invention can have a variety of different shapes and configurations, e.g., spheres, elongated plates, discs, short fibers, or the like, which may or may not be useful for providing desired performance characteristics. For example, granule cores of this invention can be specifically configured to provide particular crack propagation characteristics or other desired physical or mechanical characteristics useful for forming the ultrahard composite construction.

Additionally, it is to be understood that the granules can be shaped having an oriented configuration, e.g., in the shape of a fiber, rod or cylinder, wherein the core occupies a central portion of the fiber or cylinder, and the shell surrounds the outer surface of the core. In forming ultrahard composite constructions from such granules having an oriented configuration, the granules can be arranged having a common orientation within the construction, e.g., all being in alignment with a particular axis running through or along the construction, or the granules can be arranged each having a random orientation within the construction.

In an example embodiment, granules cores of this invention can be configured having an average particle size in the range of from about 10 to 1,000 micrometers, preferably in the range of from about 50 to 500 micrometers, and more preferably in the range of from about 100 to 300 micrometers. It is to be understood that the exact size of the granule core can and will vary depending on such factors as the materials that are used to form the granule core, and the end properties that are desired in the ultrahard composite construction to meet the end use application.

As described above, granules of this invention comprise a shell or coating 22 that surrounds the core 20. The shell or coating of the granule may, depending on the particular embodiment, operate to form a matrix region or phase in the ultrahard composite construction once the granules are combined and sintered at HP/HT conditions. This matrix region or phase can be substantially continuous throughout the construction. Granules of this invention may comprise a core having a single coating or shell, or may comprise multiple coatings or shells, e.g., the core may have a first shell surrounding the core and one or more further shells surrounding each previous shell. The number of shells or coatings that are used to form the granule will depend on the particular combination of properties that are desired for the resulting ultrahard composite construction, and provides a further tool for achieving desired combinations of material properties.

Materials useful for forming the coating or shell can be selected from the same group of ultrahard materials or precursor components described above for forming the granule core Additionally, the granule core and shell can each be formed from the same or different ultrahard materials or precursor components. For example, granules of this invention can have a post-sintered core-coating construction that is PCD-PCD, PCD-PcBN, PcBN-PcBN, or PcBN-PCD depending on the particular application demands.

Where the granule core and coating are both formed from the same ultrahard material or precursor components, it is to be understood that while both the core and coating will have the same ultrahard constituent, e.g., PCD or PcBN, diamond or cBN, the materials used to form the granule core and shell will each have one or more different characteristics specifically selected to provided a desired different physical property, such as wear resistance or toughness to the composite construction. Accordingly, it is to be understood that although the core and shell portions of granules of this invention may be formed from the same general type of ultrahard material or precursor components, the physical properties of these materials in the sintered ultrahard composite construction will be different, e.g., although the core and shell both comprise PCD when sintered, the core may have a different wear resistance and/or toughness than the shell.

In certain applications, e.g., where infiltration into the granule core by a solvent metal catalyst material is not desired, the shell or coating can be formed from a material that is not or does not include a solvent metal catalyst. An example of such an application would include that where the granule core is formed from PCD or diamond grains that are lean or substantially free of the catalyst/binder material and it is desired to maintain this condition during sintering. Materials useful for forming the shell in this example include ceramic or refractory materials capable of forming a protective carbide layer during sintering. In this example, the shell or coating material would operate to insulate the granule core from unwanted infiltration of solvent metal catalyst materials possibly present in a further material phase within which the coated granules are dispersed or surrounded.

The different properties in the materials used to form the granule core and shell can be achieved by using different proportions of one or more constituents in the core and/or shell material, e.g., by using a different volume fraction of the ultrahard constituent or precursor. Alternatively, or additionally, the different properties can be achieved by using an additional material to form one or both of the granule shell and core. Still further, such different properties can be achieved by using different sizes or grades of one or more of the constituents in the materials used to form the granule core and shell, e.g., by using a different grain size of the ultrahard material or precursor component. Still further, such different properties may be achieved by combining two or more of the above identified parameters. It is to be understood that the different properties desired in the granule core and shell, and the manner in which such different properties are achieved, can and will vary depending on such factors as the materials selected to form the granules, and the desired physical properties for the ultrahard composite construction.

For example, desired differences in the granule core and shell properties can be achieved by a combination of using a differently sized constituent material in the core and shell in addition to using a different volume fraction of one or more of constituent materials in the core and shell. In another example, the desired differences in the granule core and shell properties can be achieved by a combination of using a differently sized constituent material in the core and shell in addition to using an additional material in one or both of the granule core and shell. Again, the manner in which the desired differences in the granule core and shell properties are achieved can and will vary depending on the physical properties desired for the ultrahard composite construction.

It has been discovered that improvements in combined properties of wear resistance and toughness, beyond those previously achieved via monolithic PCD or other PCD composite constructions, are achieved when ultrahard composite constructions of this invention are formed by using a granule comprising a core formed from an ultrahard material or precursor components having a high degree of wear resistance, and a shell formed from an ultrahard material or precursor components having a high degree of toughness. While this is but one example of a particular granule construction useful for forming ultrahard composite constrictions, it is to be understood that useful ultrahard composite constructions of this invention can also be formed by using granules comprising a core formed an ultrahard material or precursor components having a high degree of toughness, and a shell formed from an ultrahard material or precursor components having a high degree of wear resistance.

In an example embodiment, the shell is formed from the same general type of ultrahard material or precursor components as the core. In this example, the shell is formed from a precursor component comprising diamond grains that forms PCD when sintered. In such example embodiment, the diamond grain size can be within the same parameters described above for forming the granule core. In one example embodiment, the diamond grains used to form the shell are sized the same as that used to form the core.

In such example embodiment, the shell material is engineered to produce an ultrahard material when sintered having a level of toughness different than that of the material used to form the core. In a preferred embodiment, the shell material has a level of toughness greater than that of the core. Such desired physical property of toughness can be achieved in the shell material by combining the diamond grains with a larger volume fraction of the binder/catalyst material, which can be selected from the same group of binder/catalyst materials noted above for forming the granule core, and/or by using different grain sizes of the material constituents, and/or by including another material useful for improving the toughness of the resulting material.

In an example embodiment, the desired increased level of toughness relative to the granule core material is achieved by using a second phase material in addition to the diamond grains and binder/catalyst. The second phase material reduces the degree of intercrystalline bonding during sintering, which operates to increase the toughness and impact resistance of the resulting material while at the same time preserving a desired level of wear resistance inherent in the resulting PCD constituent.

The second phase material could be any covalent, ionic, or metallically bonded substance that sufficiently interferes with intercrystalline bonding of the diamond during HP/HT processing. Examples of such substances include: particulate oxides, for example, aluminum oxide and zirconium oxide; metal such as of tungsten, vanadium, titanium; and metallic particulates such as cobalt, nickel, and iron; nitrides; and mixtures of any or all of the foregoing materials. Further examples include cermet materials that include hard grains of carbides, nitrides, carbonitrides or borides or a mixture thereof formed from refractory metals such as W, Ti, Mo, Nb, V, Hf, Ta, Cr, and that may further include a metallic cementing agent.

In an example embodiment, the second phase material is cemented tungsten carbide (WC—Co) and is provided in the mixture in the form of sintered WC—Co grains. In such example embodiment, the WC/Co grains comprise approximately 12 percent by weight cobalt and have an average particle size in the range of from about 5 to 50 micrometers, and more preferably from about 10 to 35 micrometers, and most preferably from about 15 to 25 micrometers.

In some embodiments, the second phase material makes up about 10 to 60 percent by volume of the material mixture formed into PCD by HP/HT processing. More preferably, the second phase material forms 20 to 50 percent by volume of the material mixture. It is to be understood that the exact volume fraction of the second phase material that is used can and will vary on such factors as the type of material chosen as the second phase material, and the end use application for the ultrahard composite construction. In such embodiment comprising the second phase material, the amount of diamond grains relative to the binder/catalyst present in the shell material is within the same parameters disclosed above for the core material, and in a preferred embodiment is the same as that present in the core material.

While the use of a second phase material has been described for forming the granule shell or coating, it is to be understood that such second phase material can also be used to form the granule core. Accordingly, granules can be formed comprising the second phase material in the granule core and/or shell depending on the particular application.

The shell material is applied to the granule core to coat and completely surround and encapsulate the granule core. Since a desired property of granules formed according to this invention, comprising the core and shell portions, is that they be capable of being stored for subsequent use as feed stock for making ultrahard material composite constructions, a feature of such granules is that the shell portion adhere to and remain adhered to the granule core.

In an example embodiment, the granule shell material is disposed onto the granule core according to a two-step process that involves first treating or processing the granule core to provide an adhesive or tacky outer surface to receive and retain the ultrahard shell material, and then placing the shell material into contact with the adhesive or tacky core outer surface so that it adheres to and is retained on the granule core surface. During these steps, it is also important to consider the amount of the shell material that is to be coated onto the granule core, as this amount will impact the volume fraction of core and shell materials forming the different material phases present in the resulting ultrahard composite construction, which will impact the properties of wear resistance and toughness in the resulting composite construction.

In an example embodiment, the granule cores can be processed or treated to provide an adhesive or tacky outer surface by a number of different methods, e.g., by coating the granule cores with an adhesive agent, or by activating an agent within the granule core that renders its outside surface adhesive or tacky. Such activating method can be carried out by heating or radiating the granule core to an activation temperature of the binding agent, or by using an activating agent to activate the binding agent. In an example embodiment, the outside surface of the granule core is rendered adhesive or tacky by exposing the granule core to an activating agent that interacts with the binding agent to cause a selective depth of the core outer surface to become adhesive or tacky.

Accordingly, for this method of treatment, it is important that the binding agent used to form the granule core and the activating agent be selected so that the combination of the two permits a desired degree of binder agent activation to produce a desired depth of adhesion along the core surface without causing the granule core to become unstable and fall apart. Accordingly, the activating agent used in such embodiment should have a limited or controlled degree of solubility with the binding agent used to form the granule to permit such a desired extent of adhesive activation within the granule core without adversely impacting the stability of the granule.

Figure 2B:
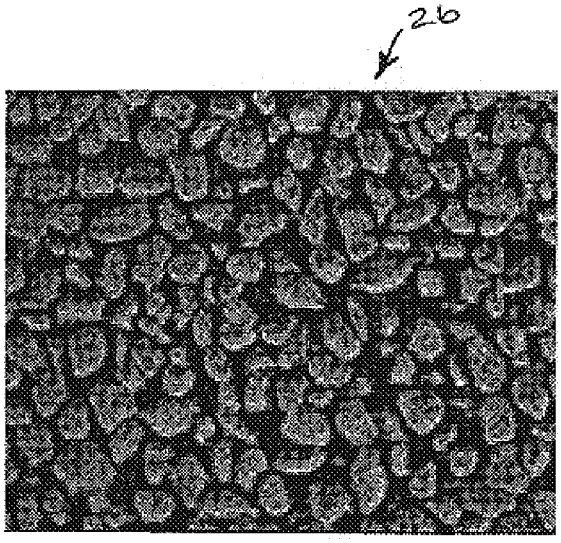
FIG. 2B is a photomicrograph of a plurality of the ultrahard material granules prepared according to principles of this invention.

Once the granule core is processed or treated to provide the adhesive or tacky outer surface, it is placed into contact with the shell material. This can be done by conventional method, such as by continuous rolling until the ultrahard powder is completely adhered to the granule cores. FIG. 2B illustrates a plurality of the granules 26 prepared according to the principles of this invention each comprising a core and a surrounding shell portion formed according to the method described above.

In an example embodiment, the binding agent used to form the granule core is polypropylene carbonate (PPC)/butyl benzyl phthalate and the activating agent that is used to cause the binding agent to become sufficiently tacky to provide the adhesive surface for the adhesive material is heptane. During the step of adhering the shell material to the adherent granule cores, it is desired that the process be conducted for such time as sufficient to produce a granule having a coating thickness calculated to provide a desired volume fraction of the core and shell materials in the sintered ultrahard composite construction.

As indicated above, the ability of the granule core to accommodate such desired degree of coating thickness will also depend on the extent or depth of the binding agent activation. For example, when a shell material is used having a degree of toughness that is greater than that of a core material having a relatively higher wear resistance, for a composite construction application calling for a higher level of wear resistance and only a moderately increased level of toughness, the granule coating thickness would be relatively thinner than that of an application calling for a relatively higher level of toughness and a reduced level of wear resistance.

Thus, the thickness of the granule coating or shell affects the separation of and the volume fraction of the plurality of granule cores in the sintered ultrahard composite construction, which resulting separation and volume fraction impacts the extent to which the properties of the plurality of cores appear in the resulting composite constriction. In an example embodiment, a 200 micrometer green-state granule core may have a shell thickness of at least 10 micrometers, preferably in the range of from about 10 to 150 micrometers, and more preferably in the range of from about 50 to 100 micrometers. Again, it is to be understood that the exact shell or coating thickness can and will vary depending on such factors as the ultrahard materials or precursor components that are used to form the granule shell and core portions, the size of the granule cores, the desired volume fraction of the granule shell and/or core ultrahard material, and the desired properties in the final sintered ultrahard composite construction that are needed to address the end use application.

While an example embodiment has been described above for making the granules useful for forming ultrahard composite constructions, which example included a description of materials used to form the granule core and shell, it is to be understood that this is but one example embodiment of how granules can be formed and that many variations are understood to be within the scope of this invention. For example, granules can be formed having a shell formed from material described above for the core, and the core formed from the material described above for the shell. Additionally, granules can be formed having the core and shell formed from the same general type of material as was described above for forming the core or the shell, in which case the materials would generally be the same but be processed, treated or engineered to provide desired different properties.

Ultrahard composite constructions of this invention have a volume fraction of the plurality of first regions or material phases in the range of from about 10 to 90 percent, preferably in the range of from about 20 to 70 percent, and more preferably in the range of from about 30 to 50 percent. The exact volume fraction of the first and second material phases in ultrahard composite constructions of this invention can and will vary depending on such factors as the types of materials used to form the granules, the relative size of the granule core and shell, and the desired properties that are needed to meet the end use application.

In certain instances, e.g., when a desired volume fraction of the granule shell material in the final composite construction exceeds that which can be practically achieved by the technique described above without causing granule instability, it may be necessary to combine the coated granules with a further amount of the shell material prior to sintering. This can be done, e.g., by either using a further adhesive agent to assist in building the shell or coating thickness, or by dispersing the granules in a further amount of free shell material prior to sintering of the ultrahard composite construction. Adhesive agents useful for increasing the extent of shell material loading include hot melt adhesives, solvent adhesives, emulsion adhesives and the like can be applied to the granule and that will provide a tacky surface to provide the desired degree of shell material thickness by being placed into contact with the shell material.

In the event that the desired volume fraction of shell material is provided by dispersing the granules into free shell material, the coated granules can be mixed together with the additional material prior to loading for HP/HT processing to ensure that the resulting composite construction comprise a uniform distribution of the plurality of ultrahard granules dispensed within the ultrahard material continuous matrix provided by the additional shell material.

Alternatively, rather than using the shell material as the free material, ultrahard constructions of this invention can be formed by using a material other than the shell material to produce a construction comprising the following material regions: (1) a plurality of first material regions each including a core phase and a surrounding shell phase formed from the plurality of sintered granules; and (2) a continuous matrix second region or phase formed from the additional matrix material, within which the plurality of first material regions is dispersed.

The use of a matrix material in addition to the granules to form ultrahard composite constructions of this invention is optional, and may serve to provide desired combinations of physical properties not otherwise obtainable by using the granules alone. The types of materials that can be used to form the matrix material in such invention embodiment can depend on whether it is desired to provide an ultrahard composite construction having an improved degree of adhesion between the matrix phase and the regions provided by the granules, or a weakened interface between the matrix phase and the regions phases provided by the granules.

In the event that an improved degree of adhesion between the matrix phase and the granules is desired, the matrix material can comprise metallic-base materials such as those selected from Group VIII elements of the Periodic table, such as Co, Ni, Fe, and Ti, and mixtures thereof. An example of such an ultrahard composite construction is one where the granule core and shell are prepared in the manner described above from a mixture of diamond grains and binder/catalyst material to form a sintered two-phase PCD granule, and the matrix material comprises Co.

In the event that a reduced or weakened interface between the granule and matrix within the ultrahard composite construction is desired, e.g., to permit preferential fracture at the interface to avoid crack propagation into the matrix, the matrix material can comprise ceramic-based materials such as those selected from the group of carbides, nitrides, oxides and mixtures thereof.

Ultrahard composite constructions of this invention are formed by subjecting the granules and any additional free shell material or additional matrix material to conventional HP/HT process used for sintering PCD or PcBN materials. If desired, ultrahard composite constructions of this invention formed in this manner can be used to form a compounded construction comprising two or more different layers that each comprise ultrahard composite constructions. In an example compounded construction, a first ultrahard composite construction having a first set of combined physical properties can be joined during HP/HT process to an underlying ultrahard composite construction having a second set of combined physical properties that are different from the first set of combined physical properties.

Additionally, ultrahard composite constructions of this invention may or may not be attached to a substrate to facilitate end use application. For use as wear and/or cutting elements in subterranean drilling applications, the composite constructions are preferably joined to a substrate during the HP/HT process. In such case, the granules are loaded into a desired container or capsule for placement adjacent the selected substrate, and the container and substrate are placed within a suitable HP/HT consolidation and sintering device.

For certain applications it may be desired that one or more intermediate layer of material be interposed between the ultrahard composite construction and any substrate. The material selected for forming the intermediate layer can be constructed by any of the methods described above for forming the granule core, shell or matrix material that was engineered to provide a transition of properties between the ultrahard composite construction and the substrate. In an example embodiment, the material selected for forming the intermediate layer would be one that would ensure formation of a strong bond between the ultrahard composite construction and the substrate and/or provide an improved degree of thermal and elastic modulus compatibility between the ultrahard composite construction and the substrate. For example, when the ultrahard composite construction comprises PCD and the substrate is a cermet material as described below, the materials used to form an intermediate layer may have properties of reduced elastic modulus and increased thermal expansion when compared to the ultrahard composite construction.

Suitable substrate materials include those conventionally used as substrates for conventional PCD and PcBN compacts, such as those formed from metallic and cermet materials. In an example embodiment, the substrate is provided in a preformed state and includes a metal solvent catalyst that is capable of infiltrating into the adjacent powder mixture during HP/HT processing to facilitate and provide a bonded attachment therewith. Suitable metal solvent catalyst materials include those selected from Group VIII elements of the Periodic table. A particularly preferred metal solvent catalyst is cobalt. In an example embodiment, the substrate is formed from cemented tungsten carbide (WC—Co).

The container or capsule is heated in a vacuum furnace to debind and drive off the binding agent from the granules. The container is then loaded into the consolidation and sintering device, e.g., a press, and the device is operated to a desired HP/HT condition to consolidate and sinter the granule materials, any additional matrix material, and to join the ultrahard composite construction to the substrate. In an example embodiment, wherein resulting ultrahard composite construction comprises PCD, the device is controlled so that the container is subjected to a HP/HT process pressure in the range of from 5 to 7 GPa and a temperature in the range of from about 1300 to 1600° C., for a sufficient period of time.

During the HP/HT process, wherein the resulting ultrahard composite construction comprises PCD, the binder/catalyst material in the core and/or shell of the granules melts and infiltrates the diamond grains in the respective cores and shells to facilitate intercrystalline diamond bonding therein. During such HP/HT process, the diamond grains in the granule shells, and in any optional matrix material that is added and that includes diamond grains and binder/catalyst material, undergo intercrystalline bonding. The diamond grains in the granule cores undergo intercrystalline bonding at discrete locations within the composite construction to form a plurality of first distinct phases within the composite construction.

In an embodiment of the invention where the coated granule shells are combined and sintered and no additional free matrix material is added, or if any free matrix material is added it is the same as that used to form the granule shells, the diamond grains in the granule shell material undergoes intercrystalline bonding to form a continuous matrix second phase or region within which the plurality of distinct phases formed from the granule cores are dispersed substantially uniformly therein. In the example embodiment described above, the first and second phases in the composite construction each comprise PCD, and one of the phases has a physical property, e.g., of toughness and/or wear resistance, that is different from the other.

Alternatively, in an embodiment of the invention where the granules are combined with a free matrix material that is different from that used to form the granule shell, the plurality of first distinct phases are defined by the sintered granule core and shell, which are dispersed within a continuous matrix second phase that is defined by the different free matrix material.

Figure 3:
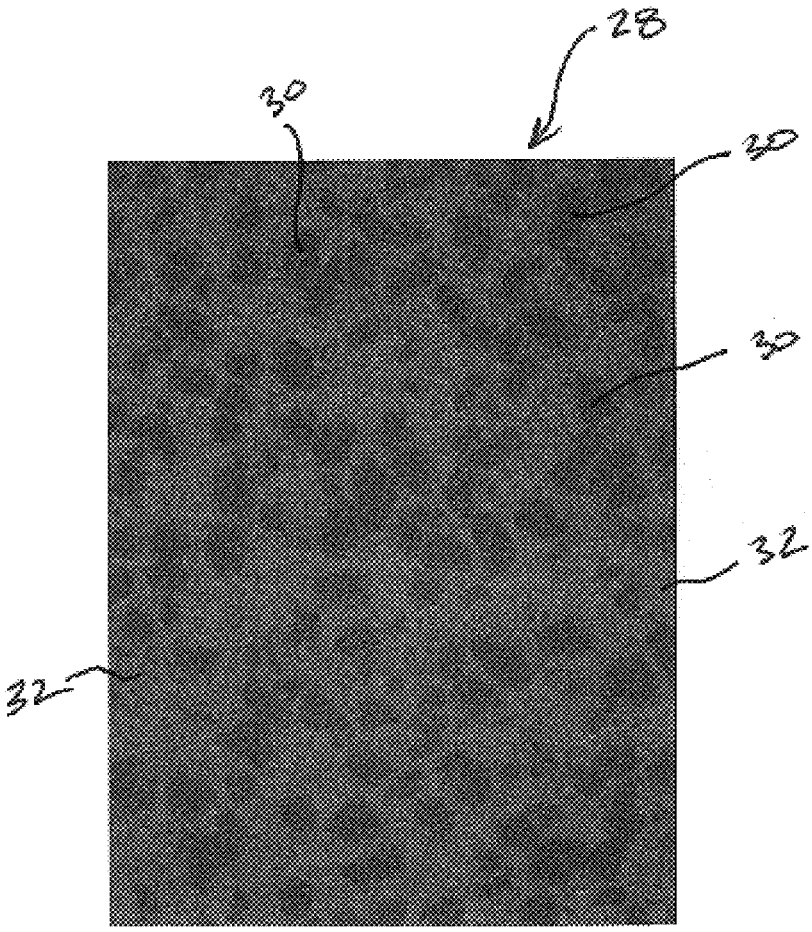
FIG. 3 is a photomicrograph of a portion of a first ultrahard composite construction prepared according to principles of this invention.

FIG. 3 is a photomicrograph of a first embodiment ultrahard composite construction 28 of this invention comprising a plurality of first phases 30, identified as dark regions in the photomicrograph, that are substantially uniformly dispersed within a matrix phase 32, identified as the relatively lighter region in the photomicrograph. The volume percent of the first phases in the resulting ultrahard composite construction was approximately 30 based on the total volume of the mixture forming the composite.

In this first embodiment example, the granules used to form the composite construction comprised a core made from a mixture of diamond grains, binder/catalyst, and binding agent having the following characteristics. The diamond grains had an average grain size of approximately 5 micrometers, the binder/catalyst material was cobalt having an average grain size of approximately 2 micrometers, and the volume percent of binder/catalyst in the diamond and binder/catalyst mixture was approximately 1 percent. The binding agent was a mixture of polypropylene carbonate (PPC) and butyl benzyl phthalate, and was present in approximately 15 percent by volume based on the total volume of the mixture forming the composite. The presintered granule core had a generally ellipsoidal shape, and had an average size of about 200 to 300 micrometers.

The shell material used to form the granules for this first example embodiment composite construction comprised a mixture of diamond grains, binder/catalyst material, and a second phase material in the form of WC—Co having the following characteristics. The diamond grains had an average grain size of approximately 5 micrometers, the binder/catalyst was cobalt having an average grain size of approximately 2 micrometers, and the amount of binder/catalyst in the diamond and binder/catalyst mixture was approximately 5 percent by volume. Approximately 40 percent by volume of WC—Co was present based on the total volume of the mixture, and was provided in the form of grains having an average size of approximately 20 micrometers. An example shell material is that disclosed in U.S. Pat. No. 6,651,757, which is incorporated herein by reference. The presintered granule shell had a thickness of approximately 120 micrometers.

The plurality of first material phases 30 were formed from the sintered granule cores, and the continuous matrix phase 32 was formed from the sintered granule shells. In this particular embodiment, the volume percent of approximately 70 percent continuous matrix phase was obtained from the granule shells without having to use additional free shell material.

Figure 4:
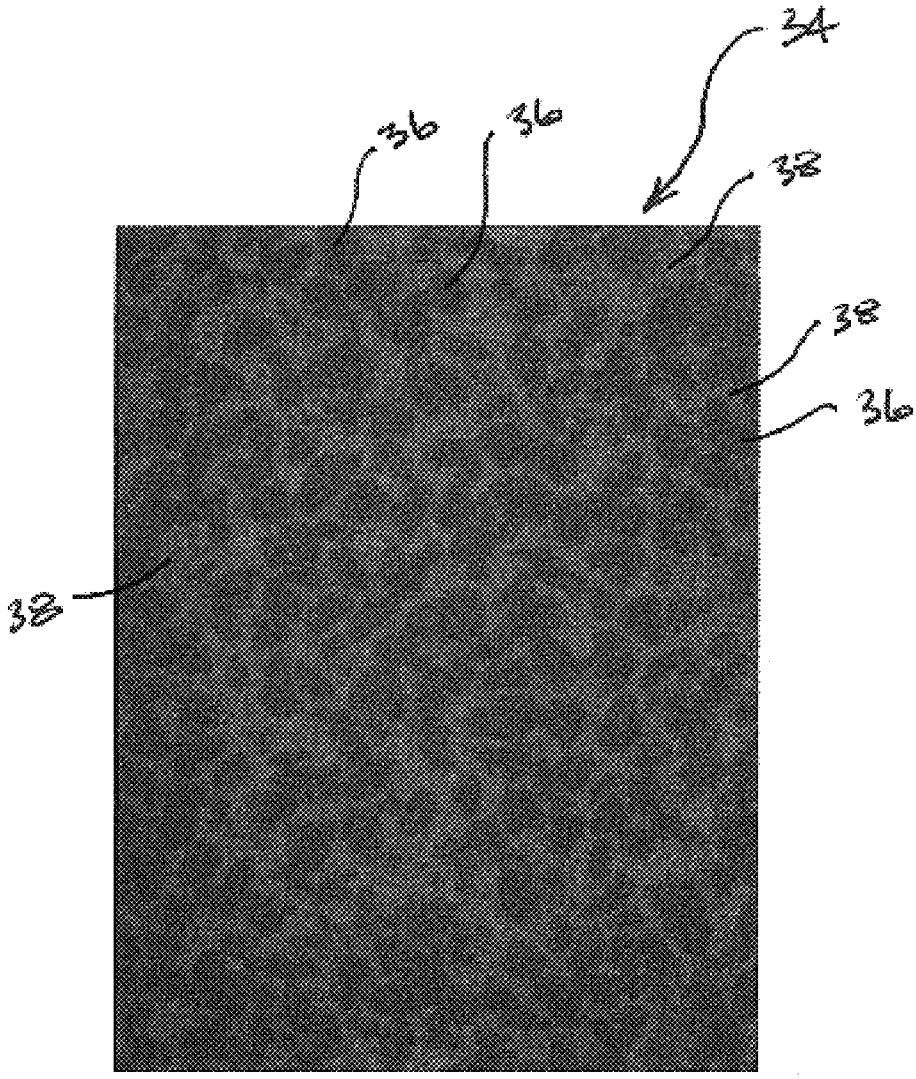
FIG. 4 is a photomicrograph of a portion of a second ultrahard composite construction prepared according to principles of this invention.

FIG. 4 is a photomicrograph of a second embodiment ultrahard composite construction 34 of this invention comprising a plurality of first phases 36, identified as dark regions in the photomicrograph, that are substantially uniformly dispersed within a continuous matrix phase 38, identified as the relatively lighter region in the photomicrograph. The materials that were used to form the granule core and shell portions were the same as that described above for the first example embodiment. However, the volume percent of the plurality of first phases in this second embodiment composite construction was increased to approximately 50 percent by volume. The increase in volume percentage of the first phases was achieved by reducing the granule shell thickness from 120 micrometers to approximately 60 micrometers.

Figure 5:
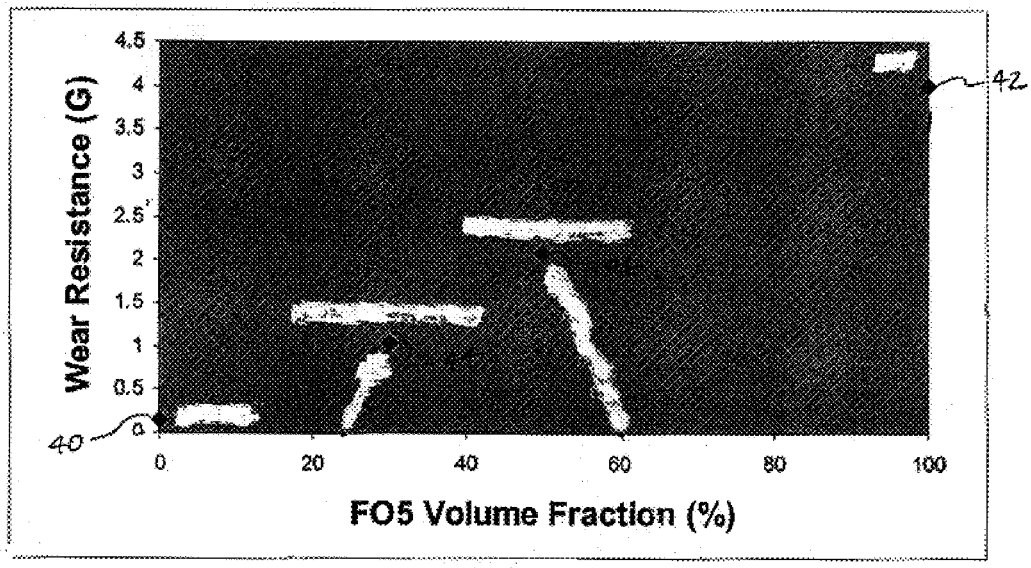
FIG. 5 is a graph plotting wear resistance v. volume fraction of the ultrahard material granules.

A feature of ultrahard composite constructions of this invention is that they can be specifically engineered to provide improved properties of wear resistance and/or toughness when compared to conventional monolithic PCD materials and known PCD composite constructions. FIG. 5 graphically illustrates the improvement in wear resistance achieved over the example shell material 40 noted above, having properties of relatively low wear resistance and relatively high toughness, when example composite constructions are formed from granules having a core formed from an example material 42 having properties of relatively high wear resistance and relatively low toughness, and when the volume fraction or percent of the granule cores or plurality of dispersed ultrahard material phases in the composite constructions is increased from 30 percent (44) to 50 percent (46).

While not illustrated on this graph, the resulting first example composite construction described above (44) not only displayed increased wear resistance when compared to the example shell material alone, but also had an improved degree of toughness when compared to the example core material alone, thereby offering an overall increased level of combined properties of wear resistance and toughness when compared to either shell or core material alone. The relative toughness of PCD can be determined by impact test method.

A feature of ultrahard composite constructions of this invention is the ability to provide improved combined properties, e.g., of toughness and wear resistance, not otherwise obtained via monolithic PCD or known PCD composite construction. This is achieved through the formation of granules, having core and shell portions selectively engineered from ultrahard materials or precursor components having certain properties, that when combined and sintered operate to produce a resulting composite construction having desired levels of such properties that are not otherwise present in the individual granule core and shell materials.

A further feature of this invention is the formation of the granules themselves and the ability to use such specially engineered granules as a starting material that can be stored as a feedstock for the subsequent production of ultrahard composite constructions. Further, the process of forming/coating the granules with the binder polymers protects the diamond, cBN, and catalyst materials from contaminating effects such as that from adsorbed gaseous species (i.e. oxygen, nitrogen, and water vapor) accumulating on the particulate surfaces, thereby providing more convenient storage and long shelf life. These features assist in making the process of forming ultrahard composite constructions more efficient.

Ultrahard composite constructions of this invention can be used in a number of different applications, such as tools for machining, cutting, mining and construction applications, where combined mechanical properties of high fracture toughness and wear resistance are highly desired. Ultrahard composite constructions of this invention can be used to form wear and cutting components in such tools as roller cone bits, percussion or hammer bits, drag bits, and a number of different cutting and machine tools. Ultrahard composite constructions can be used to form a wear surface in such applications in the form of one or more substrate coating layers, or can be used to form the substrate itself.

Figure 6:
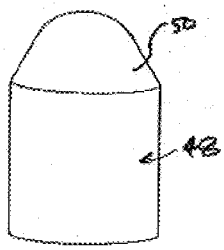
FIG. 6 is a schematic perspective side view of a cutting element in the form of an insert comprising an ultrahard composite construction of this invention.

FIG. 6, for example, illustrates a cutting element in the form of a mining or drill bit insert 48 that is either formed entirely from or that includes a cutting or wear surface 50 formed from the ultrahard composite construction of this invention. While the insert depicted in FIG. 6 has a particular configuration, it is to be understood that this is configuration is representative of one of many different insert configurations useful for mining or drilling, and that ultrahard composite constructions are understood within the scope of this invention to be used with all such different insert configurations.

Figure 7:
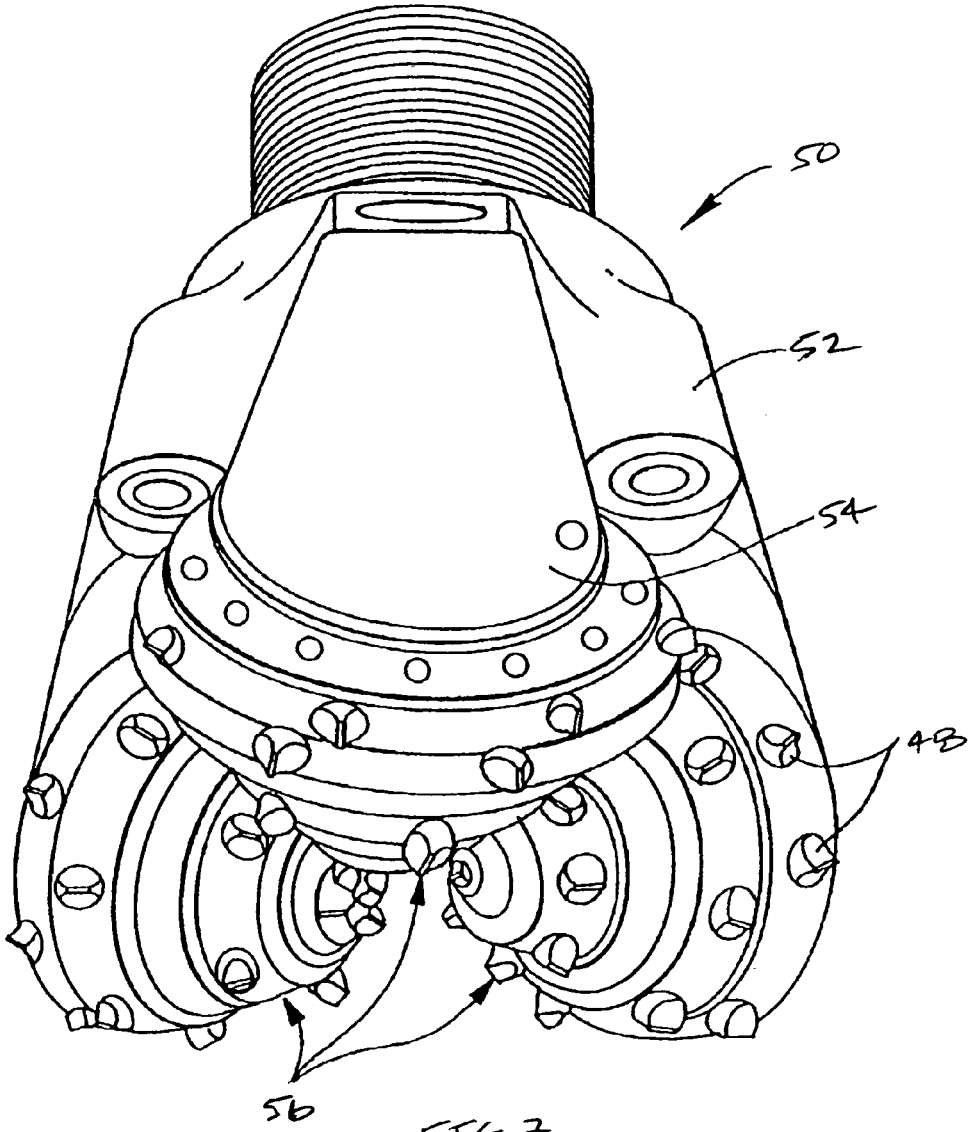
FIG. 7 is a perspective side view of a roller cone drill bit comprising a number of the inserts of FIG. 6.

Referring to FIG. 7, such an insert 48 can be used with a roller cone drill bit 50 comprising a body 52 having three legs 54, and a cutter cone 56 mounted on a lower end of each leg. Each roller cone bit insert 48 can comprise the ultrahard composite construction of this invention. The inserts 48 are provided in the surfaces of the cutter cones 56 for bearing on a rock formation being drilled.

Figure 8:
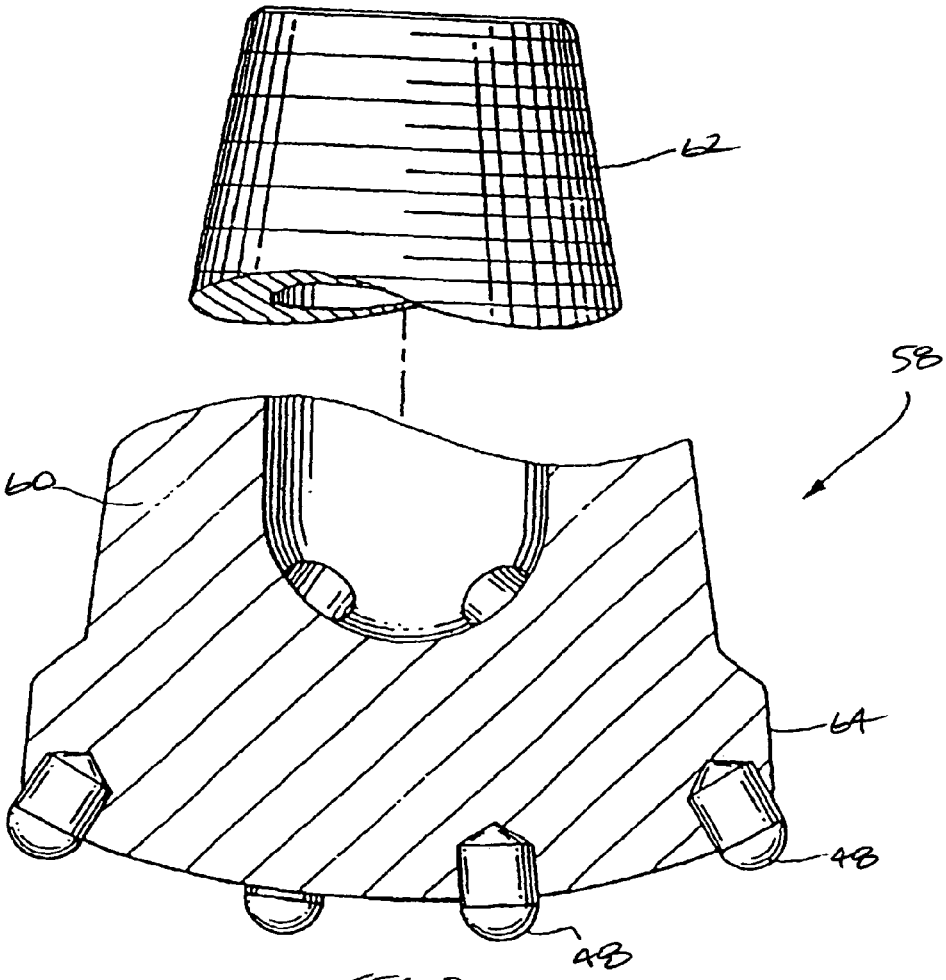
FIG. 8 is a perspective side view of a percussion or hammer bit comprising a number of the inserts of FIG. 6.

Referring to FIG. 8, inserts 48 comprising ultrahard composite constructions of this invention can also be used with a percussion or hammer bit 58, comprising a hollow steel body 60 having a threaded pin 62 on an end of the body for assembling the bit onto a drill string (not shown) for drilling oil wells and the like. A plurality of the inserts 48 are provided in the surface of a head 64 of the body 60 for bearing on the subterranean formation being drilled.

Figure 9:
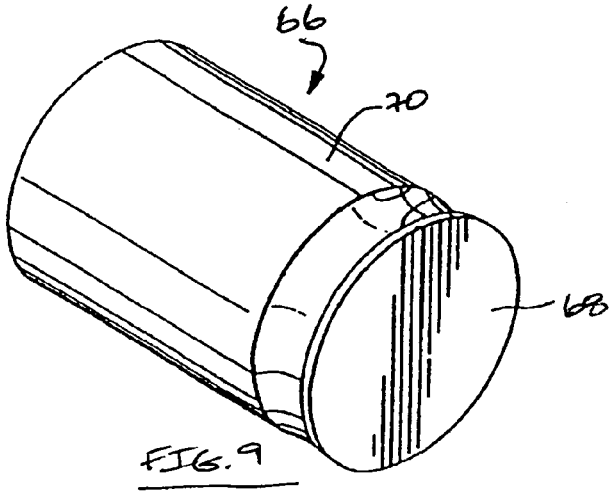
FIG. 9 is a schematic perspective side view of a cutting element in the form of a shear cutter comprising an ultrahard composite construction of this invention.

Referring to FIG. 9, ultrahard composite constructions of this invention can also be used to form shear cutters 66 that are used, for example, with a drag bit for drilling subterranean formations. More specifically, ultrahard composite constructions of this invention can be used to form a sintered surface layer on a cutting or wear surface 68 of the shear cutter substrate 70. While the shear cutter depicted in FIG. 9 has a particular configuration, it is to be understood that this is configuration is representative of one of many different shear cutter configurations useful for mining or drilling, and that ultrahard composite constructions are understood within the scope of this invention to be used with all such different shear cutter configurations.

Figure 10:
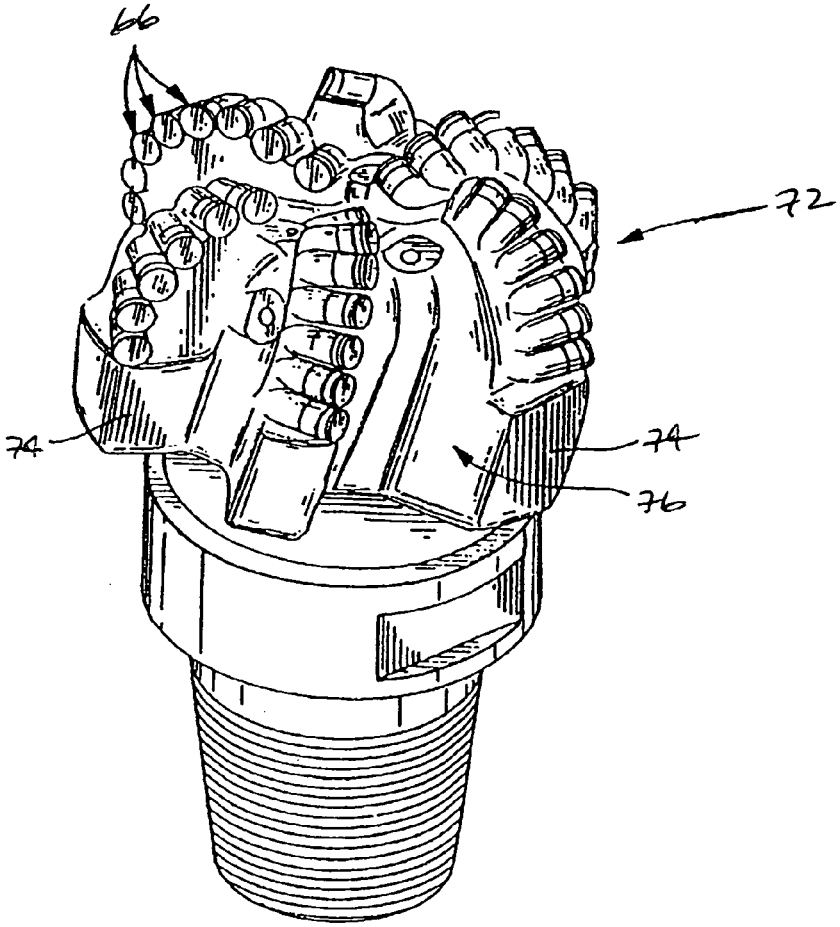
FIG. 10 is a perspective side view of a drag bit comprising a number of the shear cutters of FIG. 9.

Referring to FIG. 10, a drag bit 72 comprises a plurality of such shear cutters 66 that are each attached to blades 74 that project outwardly from a head 76 of the drag bit for cutting against the subterranean formation being drilled.

Although, limited embodiments of ultrahard composite constructions, granules for forming the same, and methods for forming the composite constructions and granules have been described and illustrated herein, many modifications and variations will be apparent to those skilled in the art. For example, while ultrahard composite constructions of this invention have been described as being useful to form a cutting, wear or working surface on a particular substrate, it is to be understood within the scope of this invention that ultrahard composite constructions can also be used to form a multiple layer structure, and/or eliminate all or part of the substrate.

Accordingly, it is to be understood that within the scope of the appended claims, ultrahard composite constructions and granules used to form the same made according to this invention may be embodied other than as specifically described herein.

What is claimed is:

1. An ultrahard composite construction comprising a plurality of first material phases dispersed within a matrix second material phase, wherein the first and second material phases each comprise ultrahard materials selected from the group consisting of polycrystalline diamond, polycrystalline cubic boron nitride, and mixtures thereof, wherein the composite construction is formed by combining a plurality of granules and subjecting the granules to high pressure/high temperature conditions, wherein the granules each comprise a core forming the composite construction first material phase, and a shell that encapsulates the core and that forms at least a portion of the composite construction second material phase, and wherein the ultrahard material used to form the plurality of first material phases has a volume fraction of ultrahard constituent different from that in the ultrahard material used to form the second material phase.

2. The ultrahard composite construction as recited in claim 1 wherein the volume fraction of ultrahard constituent in one of first and second material phases is 90 percent by volume or greater based on the total volume of the ultrahard material in such material phase, and the volume fraction of ultrahard constituent in the other of the first and second material phases is less than about 90 percent of the total volume of the ultrahard material in such other material phase.

3. The ultrahard composite construction as recited in claim 1 wherein the plurality of first phases has a wear resistance that is different from that of the second phase.

4. The ultra-hard composite construction as recited in claim 1 wherein the plurality of first phases has a toughness that is different from that of the second phase.

5. The ultra-hard composite construction as recited in claim 1 wherein the plurality of first phases and the second phase are each formed from an ultrahard precursor component having the same average particle size.

6. The ultrahard composite construction as recited in claim 1 wherein the first and second phases are both polycrystalline diamond, wherein each granule core and shell comprise a mixture of diamond grains and binder/material, and wherein the diamond grains used to the granule core and shell have the same average particle size.

7. The ultrahard composite construction as recited in claim 1 wherein one of the first and second phases includes a cermet material and has a toughness that is different from the other of the first and second phases.

8. The ultrahard composite construction as recited in claim 1 wherein the granule shell is formed by the process of treating the granule core to provide a tacky surface and coating the tacky surface with the ultrahard material used to form the at least portion of the composite construction second material phase.

9. The ultrahard composite construction as recited in claim 8 wherein the process of treating the granule comprises applying an activating agent to the granule core that interacts with a binding agent in the core to form the tacky surface.

10. The ultrahard composite construction as recited in claim 1 wherein at least a portion of the second material phase is formed from an ultrahard material that is different from that used to form the granule shell.

11. The ultrahard composite construction as recited in claim 1 wherein the granule includes a first shell surrounding the core, and a second shell surrounding the first shell.

12. The ultrahard composite construction as recited in claim 1 wherein the prior to being subjected to the high pressure/high temperature process, the granule core and shell comprise materials selected from the group consisting of polycrystalline diamond, diamond grains, polycrystalline cubic boron nitride, cubic boron nitride grains, and mixtures thereof.

13. An ultrahard composite construction comprising:

a plurality of first material phases formed from polycrystalline diamond; and a substantially continuous matrix second material phase that is formed from polycrystalline diamond, wherein the plurality of first material phases are dispersed within the second material phase;

wherein the composite construction is formed by the process of:

combining together a plurality of granules that each include a core that forms the plurality of first material phases, and a shell that encapsulates the core and forms at least a portion of the second material phase, wherein the granule core and shell comprise diamond grains, and wherein the volume fraction of diamond grains used to form the core is different from that used to form the shell; and subjecting the combined granules to high pressure/high temperature conditions to produce the composite construction.

14. The ultrahard composite construction as recited in claim 13 wherein the volume fraction of diamond grains used to form one of the granule core and shell is about 90 percent or greater, and the volume fraction of diamond grains used to form the other of the granule core and shell is less than about 90 percent.

15. The ultrahard composite construction as recited in claim 13 wherein the granule core has an average particle size of from about 100 to 300 micrometers, and the shell has an average thickness of from about 10 to 150 micrometers.

16. The ultrahard composite construction as recited in claim 13 wherein the diamond grains used to form the granule core and shell have the same average particle size.

17. The ultrahard composite construction as recited in claim 13 wherein the process of forming the composite construction further comprises before the step of combining, forming the granule shell by treating the granule core to provide a tacky outer surface and coating the tacky outer surface with the diamond grains.

18. The ultrahard composite construction as recited in claim 13 wherein the plurality of first material phases have a property selected from the group consisting of toughness and wear resistance that is different from that of the second material phase.

19. The ultrahard composite construction as recited in claim 13 wherein the plurality of first material phases has a higher degree of wear resistance than the second material phase, and wherein the second material phase has a higher degree of toughness than the plurality of first material phases.

20. The ultrahard composite construction as recited in claim 13 further comprising, during the step of combining, adding a further material to the combination of granules to form at least a portion of the second material phase, the further material selected from the group consisting of diamond grains, cBN grains, cermet materials, metal solvent catalysts, and mixtures thereof.

21. The ultrahard composite construction as recited in claim 13 wherein the further material comprises a volume fraction of diamond grains that is different from that of the diamond grains in the shell.

22. An ultrahard composite construction compact prepared according to claim 13 further comprising during the step of combining, adding a substrate to the combined plurality of granules, and wherein during the step of subjecting, the combined granules are bonded to the substrate.

23. The ultrahard composite construction compact as recited in claim 22 further comprising one or more intermediate layer interposed between and bonded to the substrate and the ultrahard composite construction.

24. A method of forming an ultrahard composite construction comprising the steps of:

forming a plurality of granules each having a central core formed from a first ultrahard material or precursor components for forming the first ultrahard material;

treating the granule core to render an outer core surface tacky;

coating the tacky outer core surface with a second ultrahard material or precursor components for forming the second ultrahard material to surround the granule core;

combining the coated granules together; and consolidating and sintering the combined coated granules at high pressure/high temperature conditions to form the ultrahard composite construction, wherein the coating on the granules forms at least a portion of a matrix ultrahard material phase, and the granule cores form a plurality of ultrahard material phases dispersed within the matrix phase.

25. The method as recited in claim 24 wherein the step of forming includes using a binding agent to form the granule core, and wherein the step of treating includes using an activating agent to interact with the binding agent to render the outer core surface tacky.

26. The method as recited in claim 24 wherein during the step of forming and coating, diamond grains are used to form the granule core and coating, and the volume fraction of diamond grains used to form the granule core is different from that used to form the granule coating.

27. The method as recited in claim 24 wherein during the step of forming and coating, diamond grains are used to form the granule core and coating, and the diamond grains used to form the granule core and shell have the same average particle size.

28. The method as recited in claim 24 before the step of consolidating and sintering, adding a further material to the coated granules that during consolidating and sintering forms a portion of the continuous matrix phase, the further material being selected from the group consisting of diamond grains, cBN grains, cermet materials, metal solvent catalysts, and mixtures thereof.

29. The method as recited in claim 28 wherein the further ultrahard material can be the same as or different than the second ultrahard material, and is formed from an ultrahard material or precursor material for forming the ultrahard material.

30. The method as recited in claim 24 before the step of consolidating and sintering, adding a substrate material to the combined coated granules, and wherein during the step of consolidating and sintering the substrate is bonded to the ultrahard composite construction.

31. The method as recited in claim 24 wherein during the step of coating, applying a further ultrahard material to surround the second ultrahard material.

32. The method as recited in claim 24 wherein during the step of forming the plurality of granules, the first ultrahard material is provided in the form of a sintered material selected from the group consisting of polycrystalline diamond, polycrystalline cubic boron nitride, and mixtures thereof.

33. The method as recited in claim 32 wherein during the step of coating, the second ultrahard material is formed from a material that does not infiltrate into the granule core during the step of consolidating and sintering.

34. A green-state composite material comprising a combined arrangement of a plurality of granules, each granule comprising:

a granule core that is formed from a first ultrahard material or precursor components for forming the same, the granule core including a binding agent;

a granule shell encapsulating the core and formed from a second ultrahard material or precursor components;

wherein the granule core and shell are formed from the same type of ultrahard material or precursor components each having a different volume proportion of ultrahard material or precursor components; and wherein upon sintering, the composite material comprises a plurality of first ultrahard material regions formed by the granule cores, and a matrix second ultrahard material that is at least partially formed by the granule shells.

35. The green-state composite material as recited in claim 34 wherein the granule shell is adhered to the core by contacting the core with an activating agent that interacts with the binding agent to make an outer surface of the core tacky.

36. The green-state composite material as recited in claim 34 wherein first and second ultrahard materials or precursor components for the first and second ultrahard materials is diamond grains, and wherein the diamond grains used to form the granule core and shell can have the same or different average particle size.

37. The green-state composite material as recited in claim 36 wherein the diamond grains used to form the granule core and shell have the same average particle size.

38. The green-state composite material as recited in claim 34 further comprising a third ultrahard material or precursor components for forming the same interposed between the plurality of granules, wherein upon the third ultrahard material or precursor components can be the same or different from the second ultrahard material or precursor components.

39. An ultrahard composite construction comprising a plurality of first material phases dispersed within a matrix second material phase, wherein the first material phases comprises bonded-together diamond crystals and is substantially free of a catalyst material, and wherein the second material phase comprises bonded-together diamond crystals and includes a catalyst material, wherein the construction is formed by subjecting a plurality of granules to high pressure/high temperature conditions, each granule comprising a core encapsulated by a shell, wherein the core and shell comprise diamond grains and respectively form the first and second material phases.

40. The ultrahard composite construction as recited in claim 39 wherein the volume fraction of diamond crystals in the first material phases is different from the fraction of diamond crystals in the second material phase.

41. An ultrahard composite construction comprising a plurality of first material phases dispersed within a matrix second material phase, wherein the first and second material phases each comprise ultrahard materials selected from the group consisting of at polycrystalline diamond, polycrystalline cubic boron nitride, and mixtures thereof, wherein the composite construction is formed by combining a plurality of granules and subjecting the granules to high pressure/high temperature conditions, wherein the granules each comprise a core forming the composite construction first material phase, and a shell that surrounds the core that forms at least a portion of the composite construction second material phase, and wherein the ultrahard material used to form the plurality of first material phases has a volume fraction of ultrahard constituent different from that in the ultrahard material used to form the second material phase, wherein the granule shell is formed by the process of treating the granule core to provide a tacky surface and coating the tacky surface with the ultrahard material used to form the at least portion of the composite construction second material phase.

42. The ultrahard composite construction as recited in claim 41 wherein the process of treating the granule comprises applying an activating agent to the granule core that interacts with a binding agent in the core to form the tacky surface.

43. An ultrahard composite construction comprising:

a plurality of first material phases formed from polycrystalline diamond; and a substantially continuous matrix second material phase that is formed from polycrystalline diamond, wherein the plurality of first material phases are dispersed within the second material phase;

wherein the composite construction is formed by the process of:

combining together a plurality of granules that each include a core that forms the plurality of first material phases, and a shell that surrounds the core and forms at least a portion of the second material phase, wherein the granule core and shell comprise diamond grains, and wherein the volume fraction of diamond grains used to form the core is different from that used to form the shell; and subjecting the combined granules to high pressure/high temperature conditions to produce the composite construction;

wherein before the step of combining, forming the granule shell by treating the granule core to provide a tacky outer surface and coating the tacky outer surface with the diamond grains.

44. A green-state composite material comprising a combined arrangement of a plurality of granules, each granule comprising:

a granule core that is formed from a first ultrahard material or precursor components for forming the same, the granule core including a binding agent;

a granule shell surrounding the core and formed from a second ultrahard material or precursor components, wherein the granule shell is adhered to the core by contacting the core with an activating agent that interacts with the binding agent to make an outer surface of the core tacky;

wherein the granule core and shell are formed from the same type of ultrahard material or precursor components each having different volume proportion of ultrahard material or precursor components; and wherein upon sintering, the composite material comprises a plurality of first ultrahard material regions formed by the granule cores, and a matrix second ultrahard material that is at least partially formed by the granules shells.

* * * * *